US011565526B2

(12) United States Patent
Tanaka

(10) Patent No.: US 11,565,526 B2
(45) Date of Patent: Jan. 31, 2023

(54) LIQUID DISCHARGING HEAD

(71) Applicant: Brother Kogyo Kabushiki Kaisha, Aichi-Ken (JP)

(72) Inventor: Taiki Tanaka, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 27 days.

(21) Appl. No.: 17/243,194

(22) Filed: Apr. 28, 2021

(65) Prior Publication Data

US 2021/0339529 A1 Nov. 4, 2021

(30) Foreign Application Priority Data

Apr. 30, 2020 (JP) ..... JP2020-080746

(51) Int. Cl.
*B41J 2/145* (2006.01)
*B41J 2/14* (2006.01)

(52) U.S. Cl.
CPC ..... *B41J 2/145* (2013.01); *B41J 2002/14338* (2013.01)

(58) Field of Classification Search
CPC ..... B41J 2/145; B41J 2002/14338
See application file for complete search history.

(56) References Cited

U.S. PATENT DOCUMENTS 9,352,570 B2 * 5/2016 Yamazaki ..... B41J 2/16588
2008/0018684 A1 * 1/2008 Nagashima ..... B41J 2/17563 347/70
2018/0287046 A1 10/2018 Hirai et al.
2020/0307210 A1 * 10/2020 Takabe ..... B41J 2/04525

FOREIGN PATENT DOCUMENTS

JP 2002-86714 A 3/2002
JP 2018-167576 A 11/2018
JP 2020104312 A * 7/2020 ..... B41J 2/1404

OTHER PUBLICATIONS

Translation of JP 2020-104312 A. (Year: 2020).*

* cited by examiner

*Primary Examiner* — Justin Seo
(74) *Attorney, Agent, or Firm* — Banner & Witcoff, Ltd.

(57) ABSTRACT

A liquid discharging head includes: a first individual channel array constructed of individual channels aligned in a first direction; and a second individual channel array constructed of individual channels aligned in the first direction. The second individual channel array is arranged side by side to the first individual channel array in a second direction orthogonal to the first direction. Each of the individual channels includes: a nozzle, at least two pressure chambers communicating with the nozzle and arranged in the first direction, and a connecting channel connecting the nozzle and the at least two pressure chambers. The connecting channel has one end in a third direction communicating with the at least two pressure chambers, and the other end in the third direction communicating with the nozzle.

9 Claims, 10 Drawing Sheets

LIQUID DISCHARGING HEAD

CROSS REFERENCE TO RELATED APPLICATION

The present application claims priority from Japanese Patent Application No. 2020-080746, filed on Apr. 30, 2020, the disclosure of which is incorporated herein by reference in its entirety.

BACKGROUND

Field of the Invention

The present disclosure relates to a liquid discharging head provided with two individual channel arrays each of which is constructed of a plurality of individual channels.

Description of the Related Art

Japanese Patent Application Laid-open No. 2002-086714 discloses a head (liquid discharging head) in which individual channels each including one nozzle opening (nozzle) and one cavity part (pressure chamber) are arranged in two arrays.

SUMMARY

In Japanese Patent Application Laid-open No. 2002-086714, the individual channels are densely arranged and the width of the pressure chamber is small. In this case, it is impossible to stably discharge or eject a liquid requiring a large discharge pressure (highly viscous ink, special glossy ink, etc.).

Therefore, in order to stably discharge the liquid as described above, the inventor of the present disclosure has devised a configuration in which each of individual channels includes a nozzle, at least two pressure chambers, and a connecting channel connecting the nozzle and the at least two pressure chambers with each other. By this configuration, a large discharge pressure by a plurality of pieces of the pressure chamber can be applied in each of the individual channels, and the liquid can be stably discharged.

However, in a case that the above-described configuration is applied to the head of Japanese Patent Application Laid-open No. 2002-086714, the following problem might occur. For example, in each of the two individual channel arrays, in a case that two pressure chambers which are included in the plurality of pressure chambers and which are adjacent to each other in a direction in which the two individual channel arrays extend (first direction) are connected by the connecting channel, and a nozzle is arranged at the center of the two pressure chambers in the first direction, a nozzle belonging to one of the two individual channel rows and a nozzle belonging to the other of the two individual channel rows are not aligned in the first direction at an equal spacing distance therebetween. In this case, any imbalance or deviation might occur in the arrangement of dots formed on a recording medium, and the image quality might be lowered.

An object of present disclosure is to provide a liquid discharging head which is capable of suppressing any lowering in the image quality even in a case that the above-described configuration is applied.

According to an aspect of present disclosure, there is provided a liquid discharging head including:

a first individual channel array which is constructed of a plurality of individual channels aligned in a first direction; and a second individual channel array which is constructed of a plurality of individual channels aligned in the first direction, the second individual channel array being arranged side by side to the first individual channel array in a second direction orthogonal to the first direction, wherein each of the individual channel includes: a nozzle; at least two pressure chambers communicating with the nozzle and arranged side by side in the first direction; and a connecting channel connecting the nozzle and the at least two pressure chambers, the connecting channel having one end, in a third direction which is orthogonal to the first direction and the second direction, communicating with the at least two pressure chambers and the other end in the third direction communicating with the nozzle, and a plurality of nozzles belonging to the first individual channel array and a plurality of nozzles belonging to the second individual channel array are arranged side by side at an equal spacing distance therebetween in the first direction.

DESCRIPTION OF THE EMBODIMENTS

First Embodiment

Figure 1:
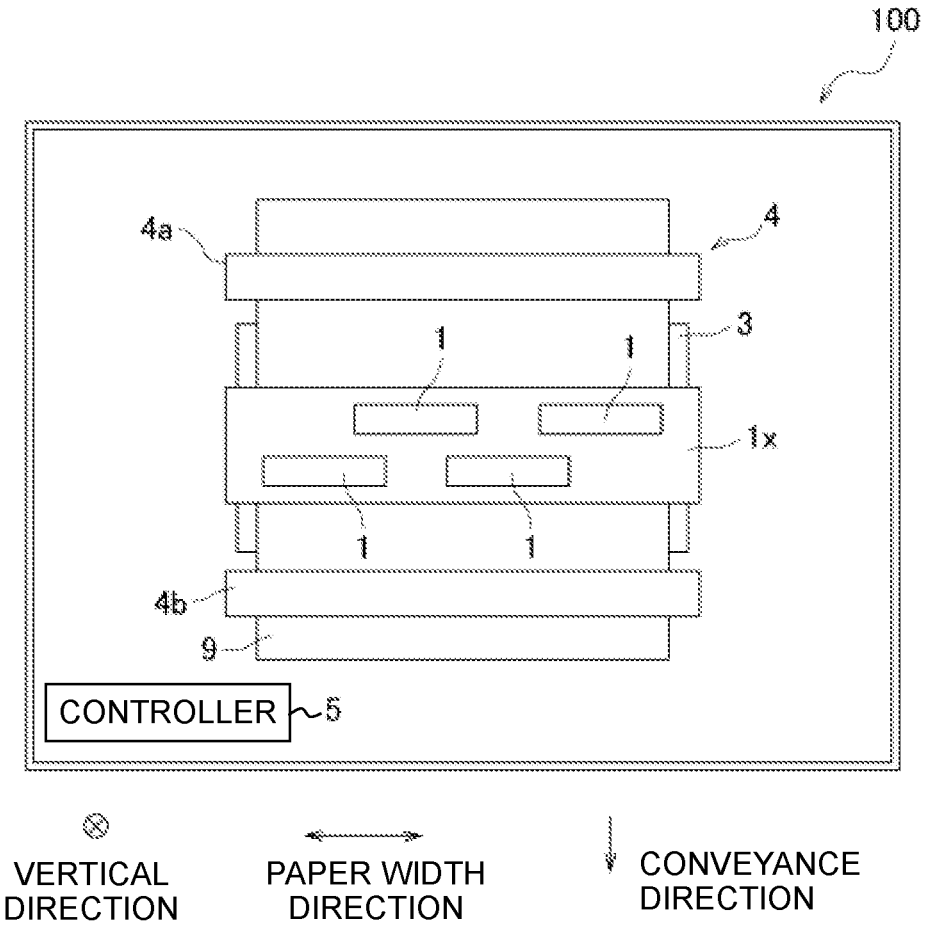
FIG. 1 is a plan view of a printer provided with a head according to a first embodiment of the present disclosure.

First, an explanation will be given about an overall configuration of a printer 100 provided with a head 1 relating to a first embodiment of present disclosure, with reference to FIG. 1.

The printer 100 includes a head unit 1*x* provided with 4 pieces of the head 1, a platen 3, a conveying mechanism 4, and a controller 5.

A paper (paper sheet) 9 is placed on an upper surface of the platen 3.

The conveying mechanism 4 has two roller pairs 4*a* and 4*b* which are arranged so as to sandwich the platen 3 therebetween in a conveyance direction. In a case that a conveying motor (not depicted in the drawings) is driven by control of the controller 5, the two roller pairs 4*a* and 4*b* rotate in a state that the paper 9 is sandwiched therebetween, thereby conveying the paper 9 in the conveyance direction.

The head unit 1*x* is elongated in a paper width direction (a direction which is orthogonal to both of the conveyance direction and a vertical direction) and is of a line system in which an ink is ejected or discharged from a nozzle 22 (see FIGS. 2 to 4) with respect to the paper 9 in a state that a position of the head unit 1*x* is fixed. Each of the four heads 1 is long in the paper width direction and the four heads 1 are arranged in a staggered manner in the paper width direction.

The controller 5 includes a ROM (Read Only Memory), a RAM (Random Access Memory) and an ASIC (Application Specific Integrated Circuit). The ASIC executes a recording processing, etc., in accordance with a program stored in the ROM. In the recording processing, the controller 5 controls a driver IC and a conveying motor (both of which are not depicted in the drawings) of each of the heads 1 based on a recording instruction (including image data) inputted from an external apparatus such as a PC, etc., and records an image on the paper 9.

Next, the configuration of each of the heads 1 will be explained, with reference to FIGS. 2 to 4.

Figure 3:
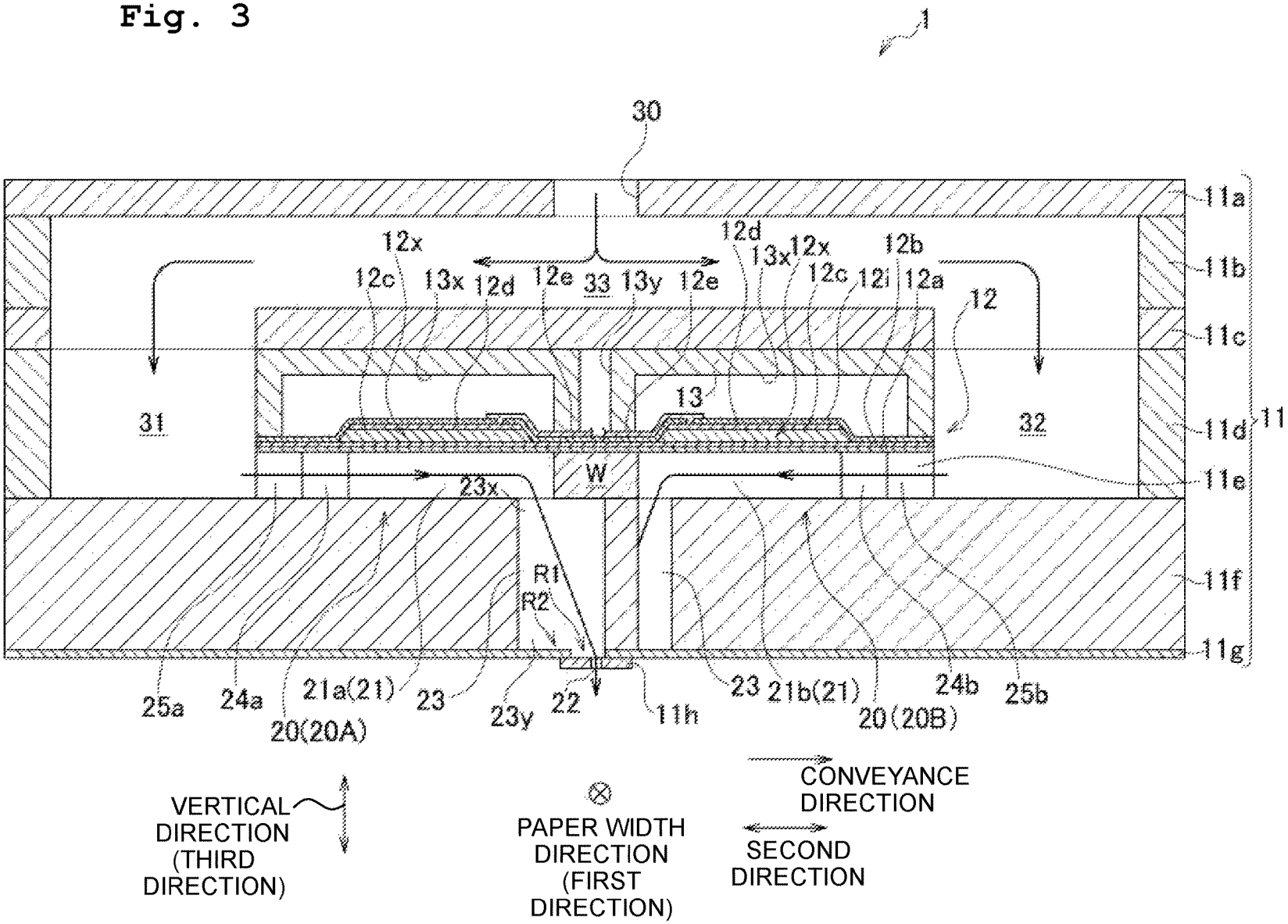
FIG. 3 is a cross-sectional view of the head along a line in FIG. 2.

As depicted in FIG. 3, the head 1 has a channel substrate 11, an actuator substrate 12, and a protective member 13.

The channel substrate 11 is constructed of eight plates 11*a* to 11*h* which are stack on one another in the vertical direction and which are joined to one another. The plates 11*a* to 11*h* are made of, for example, a resin (e.g., LCP: liquid crystal polymer) or a metal (e.g., SUS: stainless steel). A through hole forming a channel is formed in each of the plates 11*a* to 11*h*. The channel includes a plurality of individual channels 20, a first common channel 31, a second common channel 32 and a linking channel 33.

Figure 2:
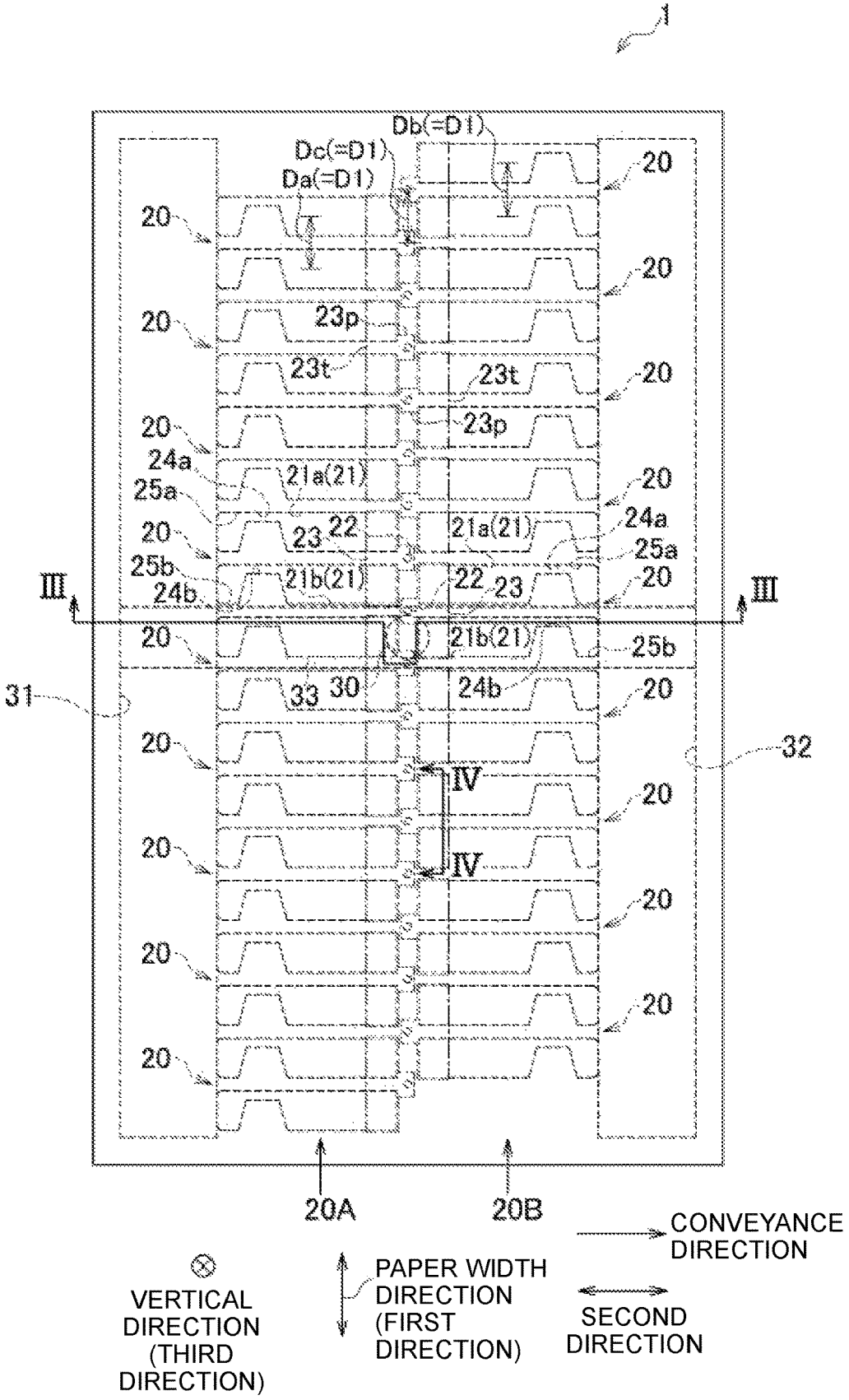
FIG. 2 is a plan view of the head.

As depicted in FIG. 2, the plurality of individual channels 20 are arranged in a staggered manner in the paper width direction (first direction) so as to form two rows or arrays (first individual channel array 20A and second individual channel array 20B). Each of the first and second individual channel arrays 20A and 20B is constructed of a plurality of individual channels 20 aligned in the first direction. The first individual channel array 20A and the second individual channel array 20B are arranged side by side in a direction parallel to the conveyance direction (second direction: a direction which is orthogonal to the first direction).

Each of the first common channel 31 and the second common channel 32 extends in the first direction and are arranged side by side in the second direction; the first and second common channels 31 and 32 sandwich the plurality of individual channels 20 therebetween in the second direction. The first common channel 31 communicates with the plurality of individual channels 20 belonging to the first individual channel array 20A. The second common channel 32 communicates with the plurality of individual channels 20 belonging to the second individual channel array 20B.

The linking channel 33 extends in the second direction and links or connects an upper end part which is substantially at the center in the first direction of the first common channel 31 and an upper end part which is substantially at the center in the first direction in the second common channel 32 to each other. An ink supply port 30 is provided on an upper part at the center in the second direction in the linking channel 33. A tube communicating with a sub tank (not depicted in the drawings) is attached to the ink supply port 30.

The sub tank communicates with a main tank which stores the ink, and stores the ink supplied from the main tank. The ink in the sub tank is supplied from the ink supply port 30 to the linking channel 33 by driving of a pump (not depicted in the drawings) under the control of the controller 5. The ink supplied to the linking channel 33 is branched or divided to one side in the second direction (left side in FIG. 2) and the other side in the second direction (right side in FIG. 2). The ink branched to the one side in second direction flows into a substantially center part in the first direction in the first common channel 31, flows in first common channel 31 toward each of one side in the first direction (an upper side in FIG. 2) and the other side in the first direction (a lower side in FIG. 2), and is supplied to the plurality of individual channels 20 belonging to the first individual channel array 20A. The ink branched to the other side in the second direction flows into a substantially central part in the first direction in the second common channel 32, flows in the second common channel 32 toward each of one side (the upper side in FIG. 2) and the other side (the lower side in FIG. 2) in the first direction, and is supplied to the plurality of individual channels 20 belonging to the second individual channel array 20B.

As depicted in FIG. 2, each of the plurality of individual channels 20 includes: one nozzle 22, two pressure chambers 21 (a first pressure chamber 21*a* and a second pressure chamber 21*b*), one connecting channel 23, two narrow-width channels 24*a* and 24*b*, and two wide-width channels 25*a* and 25*b*.

In the following, the above-described elements included in each of the plurality of individual channels 20 will be explained.

The two pressure chambers 21 (first pressure chamber 21*a* and second pressure chamber 21*b*) have a substantially rectangular shape which is long in the second direction in a plane which is orthogonal to a vertical direction (third direction: a direction orthogonal to the first direction and the second direction); the two pressure chambers 21 are arranged side by side in the first direction. The connecting channel 23 is connected to one end in the second direction of the first pressure chamber 21*a*, and the narrow-width channel 24*a* is connected to the other end in the second direction of first pressure chamber 21*a*. The connecting channel 23 is connected to one end in the second direction of the second pressure chamber 21*b*, and the narrow-width channel 24*b* is connected to the other end in the second direction of the second pressure chamber 21*b*.

The narrow-width channels 24*a* and 24*b* have a width which is smaller than a width (length in the first direction) of the first and second pressure chambers 21*a* and 21*b*, and function as a throttle. Each of the narrow-width channels 24*a* and 24*b* extends in the second direction from one end in the first direction (upper end in FIG. 2) of one of the first and second pressure chambers 21*a* and 21*b* corresponding thereto.

The wide-width channels 25*a* and 25*b* have a width which is substantially same as the width (length in the first direction) of the first and second pressure chambers 21*a* and 21*b*. The wide-width channels 25*a* and 25*b* are arranged at respective positions each of which is coincident, in the first direction, with the position of one of the first and second pressure chambers 21*a* and 21*b* corresponding thereto.

The narrow-width channel 24*a* and the wide-width channel 25*a* are arranged side by side with respect to the first pressure chamber 21*a* in the second direction. The narrow-width channel 24*a* is arranged between the first pressure chamber 21*a* and the wide-width channel 25*a* in the second direction.

The narrow-width channel 24*b* and the wide-width channel 25*b* are arranged side by side with respect to the second pressure chamber 21*b* in the second direction. The narrow-width channel 24*b* is arranged between the second pressure chamber 21*b* and the wide-width channel 25*b* in the second direction.

The narrow-width channel 24*a* and the wide-width channel 25*a* are arranged, in the second direction, between the first common channel 31 and the first pressure chamber 21*a* of (belonging to) the first individual channel array 20A. These narrow-width channel 24*a* and wide-width channel 25*a* communicate the first common channel 31 with the first pressure chamber 21*a* of (belonging to) the first individual channel array 20A.

The narrow-width channel 24*b* and the wide-width channel 25*b* are arranged, in the second direction, between the first common channel 31 and the second pressure chamber 21*b* of (belonging to) the first individual channel array 20A. These narrow-width channel 24*b* and wide-width channel 25*b* communicate the first common channel 31 with the second pressure chamber 21*b* of (belonging to) the first individual channel array 20A.

The narrow-width channel 24*a* and the wide-width channel 25*a* are arranged, in the second direction, between the second common channel 32 and the first pressure chamber 21*a* of (belonging to) the second individual channel array 20B. These narrow-width channel 24*a* and wide-width channel 25*a* communicate the second common channel 32 with the first pressure chamber 21*a* of (belonging to) the second individual channel array 20B.

The narrow-width channel 24*b* and the wide-width channel 25*b* are arranged, in second direction, between the second common channel 32 and the second pressure chamber 21*b* of (belonging to) the second individual channel array 20B. These narrow-width channel 24*b* and wide-width channel 25*b* communicate the second common channel 32 with the second pressure chamber 21*b* of (belonging to) the second individual channel array 20B.

As depicted in FIG. 3, the first and second pressure chambers 21*a* and 21*b*, the narrow-width channels 24*a* and 24*b*, and the wide-width channels 25*a* and 25*b* are constructed of through holes formed in the plate 11*e* (in other words, recessed parts formed in a stacked body of a vibration plate 12*a* (to be described later on) and the plate 11*e*).

Figure 4:
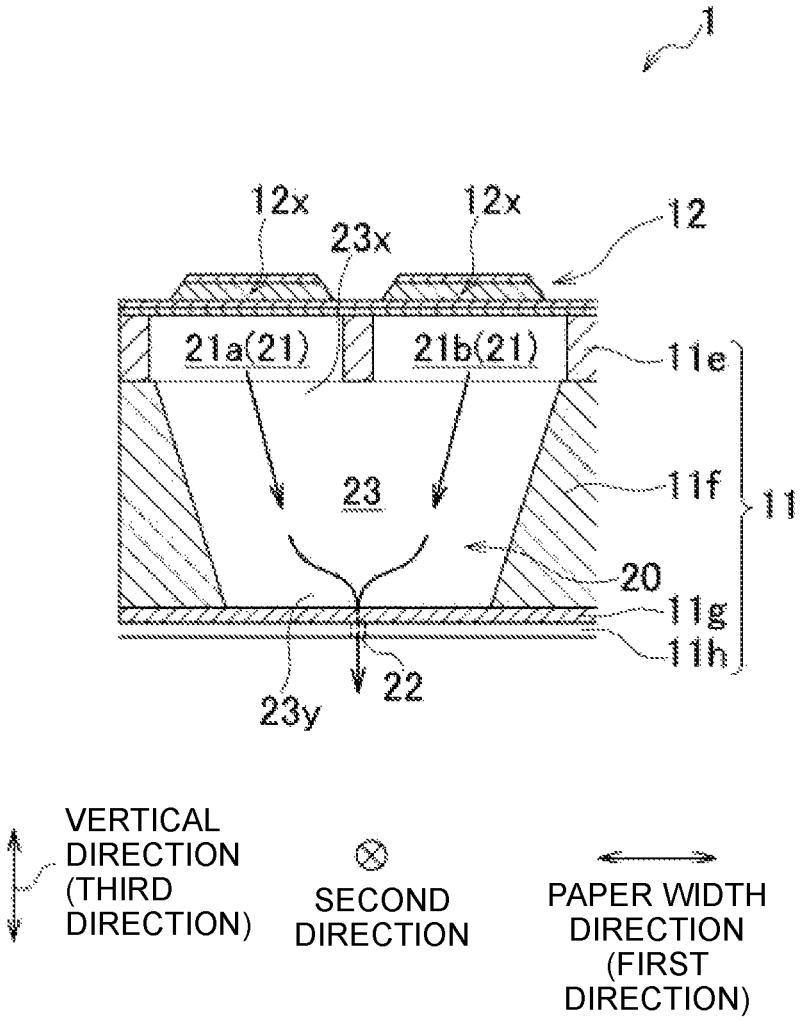
FIG. 4 is a cross-sectional view of the head along a IV-IV line of FIG. 2.

As depicted in FIGS. 3 and 4, the connecting channel 23 is constructed of through holes formed in the plates 11*f* and 11*g*, and connects the two pressure chambers 21 (first pressure chamber 21*a* and second pressure chamber 21*b*) and the nozzle 22 with one another. That is, in each of the plurality of individual channels 20, the two pressure chambers 21 (first pressure chamber 21*a* and second pressure chamber 21*b*) communicate with one nozzle 22 via the connecting channel 23. The connecting channel 23 has one end (upper end) 23*x* in the third direction communicating with the first and second pressure chambers 21*a* and 21*b* and the other end (lower end) 23*y* in the third direction communicating with the nozzle 22. The connecting channel 23 extends along the third direction from the one end 23*x* to the other end 23*y* in the third direction. The connecting channel 23 communicates with the first and second pressure chambers 21*a* and 21*b* and the nozzle 22, but does not communicate with any other parts or elements which are different from the first and second pressure chambers 21*a* and 21*b* and the nozzle 22.

As depicted in FIG. 2, the connecting channel 23 is T-shaped (shape of a letter "T") in the plane orthogonal to the third direction, and has a rectangular part 23*t* extending in the first direction over one ends in the second direction of respective two pressure chambers 21 (first pressure chamber 21*a* and second pressure chamber 21*b*), corresponding to the connecting channel 23, and a projected part 23*p* projecting from the rectangular part 23*t* in the second direction toward a side away from the first and second pressure chambers 21*a* and 21*b* and provided with the nozzle 22 in a lower surface thereof.

As depicted in FIG. 4, the connecting channel 23 has an inverted trapezoidal shape in a cross-section orthogonal to the second direction (a cross section along the first direction and the third direction). The nozzle 22 is located at a center between the two pressure chambers 21 (first pressure chamber 21*a* and second pressure chamber 21*b*) in the first direction.

As depicted in FIGS. 3 and 4, the nozzle 22 is constructed of a through hole formed in the plate 11*h*, and is opened in a lower surface of the channel substrate 11.

Here, the plate 11*h* corresponds to a "first plate" of present disclosure, and the plate 11*g* corresponds to a "second plate" of the present disclosure. As depicted in FIG. 3, the plate 11*g* is stack in the third direction with respect to the plate 11*h*, and has a through hole constructing a part of the other end 23*y* of the connecting channel 23. The through hole of the plate 11*g* is covered with the plate 11*h*.

The other end 23*y* (the bottom part of the connecting channel 23) is divided into two areas in the second direction, and includes a first area R1 which is defined by the plate 11*h* and a second area R2 which is arranged side by side with respect to the first area R1 in the second direction and which is defined by the plate 11*g*. The first area R1 is positioned at a location below the second area R2.

In the second direction, whereas the plate 11*g* has a length which is same as the six plates 11*a* to 11*f* positioned at a location above the plate 11*g*, the plate 11*h* is shorter than the other plates 11*a* to 11*g*. The length in the second direction of the plate 11*h* is approximately same as a length in the second direction of a partition wall W between the pressure chamber 21 of the first individual channel array 20A and the pressure chamber 21 of the second individual channel array 20B. The length in the second direction of the partition wall W is, for example, in a range of 2 mm to 4 mm.

The individual channels 20 of such a configuration as described above are arranged in the first direction at an equal spacing distance therebetween in each of the individual channel arrays 20A and 20B (see FIG. 2).

Specifically, as depicted in FIG. 2, in each of the first individual channel array 20A and the second individual channel array 20B, a set of two pressure chambers 21*a* and 21*b* constructing each of the plurality of individual channels 20 are arranged side by side in the first direction, and a plurality of pieces of the pressure chamber 21 are arranged side by side in the first direction at an equal spacing distance therebetween. A center-to-center distance Da in the first direction between two pressure chambers 21 which are adjacent to each other in the first direction in the first individual channel array 20A and a center-to-center distance Db in the first direction between two pressure chambers 21 which are adjacent to each other in the first direction in the second individual channel array 20B are a same distance which is a first distance D1. The first distance D1 is, for example, in a range of 20 μm to 100 μm.

The plurality of pressure chambers 21 belonging to the first individual channel array 20A are arranged to be shifted in first direction, by the first distance D1, with respect to the plurality of pressure chambers 21 belonging to the second individual channel array 20B. Specifically, as depicted in FIG. 2, among the plurality of pressure chambers 21 belonging to the second individual channel array 20B, one pressure chamber 21 located at one end in the first direction (upper end in FIG. 2) does not overlap in the second direction with any one of the plurality of pressure chambers 21 belonging to the first individual channel array 20A, and each of the remaining pressure chambers 21 overlaps in the second direction with one of the plurality of pressure chambers 21 belonging to the first individual channel array 20A. Among the plurality of pressure chambers 21 belonging to the first individual channel array 20A, one pressure chamber 21 located at the other end in the first direction (lower end in FIG. 2) does not overlap in the second direction with any one of the plurality of pressure chambers 21 belonging to the second individual channel array 20B, and each of remaining pressure chambers 21 overlaps in the second direction with any one of the plurality of pressure chambers 21 belonging to the second individual channel array 20B.

Each of the nozzles 22 belonging to the first individual channel array 20A is arranged at the other side in the second direction (right side in FIGS. 2 and 3) with respect to one of the plurality of pressure chambers 21 belonging to the first individual channel array 20A. Each of the nozzles 22 belonging to the second individual channel array 20B is arranged at the one side in the second direction (left side in FIGS. 2 and 3) with respect to one of the plurality of pressure chambers 21 belonging to the second individual channel array 20B. As depicted in FIG. 2, the nozzles 22 belonging to the first individual channel array 20A and the nozzles 22 belonging to the second individual channel array 20B are alternately arranged in the first direction and between, in the second direction, the plurality of pressure chambers 21 belonging to the first individual channel array 20A and the plurality of pressure chambers 21 belonging to the second individual channel array 20B. These nozzles 22 are arranged in one array (row) along the first direction and at an equal spacing distance therebetween in the first direction. A center-to-center distance Dc in the first direction between two nozzles 22 which are included in the nozzles 22 and which are adjacent to each other in the first direction is the first distance D1 which is same as the center-to-center distances Da and Db in the first direction between the pressure chambers 21 as described above.

The arrangement of the projected parts 23*p* of the connecting channels 23 is same as that of the nozzles 22. That is, as depicted in FIG. 2, the projected parts 23*p* of the connecting channels 23 belonging to the first individual channel array 20A and the projected parts 23*p* of the connecting channels 23 belonging to the second individual channel array 20B are arranged alternately in the first direction and between, in second direction, the plurality of pressure chambers 21 belonging to the first individual channel array 20A and the plurality of pressure chambers 21 belonging to the second individual channel array 20B. These projected parts 23*p* are arranged in the first direction in one array (row) and are arranged at an equal spacing distance therebetween in the first direction.

As depicted in FIG. 3, the actuator substrate 12 is fixed to an upper surface of the plate 11*e*, and includes a vibration plate 12*a*, a common electrode 12*b*, a plurality piezoelectric bodies 12*c* and a plurality of individual electrodes 12*d* in this order from a lower part of the actuator substrate 12.

The vibration plate 12*a* and the common electrode 12*b* are arranged in an entire area of the upper surface of the plate 11*e* and cover all of the pressure chambers 21 formed in the plate 11*e*. On the other hand, each of the plurality of piezoelectric bodies 12*c* and each of the plurality of individual electrodes 12*d* are provided on one of the plurality of pressure chambers 21, and overlap with one of the plurality of pressure chambers 21 in the third direction.

The actuator substrate 12 further includes an insulative film 12*i* and a plurality of wirings 21*e*.

The insulative film 12*i* is constructed of silicon dioxide ($SiO_2$), etc., and covers a part, of the upper surface of the common electrode 12*b*, which is not provided with the plurality of piezoelectric bodies 12*c*, a side surface of each of the plurality of piezoelectric bodies 12*c*, and upper surfaces of the plurality of individual electrodes 12*d*. In the insulative film 12*i*, a through hole is provided on a part, of the insulative film 12*i*, which overlaps with each of the plurality of individual electrodes 12*d* in the third direction.

The plurality of wirings 12*e* are formed on the insulative film 12*i*. Each of the plurality of wirings 12*e* is provided on one of the plurality of individual electrodes 12*d*; a forward end of each of the plurality of wirings 12*e* enters into the above-described through hole of the insulative film 12, thereby allowing each of the plurality of wirings 12*e* to be electrically connected with an individual electrode 12*d* included in the plurality of individual electrodes 12*d* and corresponding thereto. Each of the plurality of wirings 12*e* is drawn to a center in the second direction of the actuator substrate 12 and is electrically connected to a wiring substrate (COF: Chip On Film, etc., not depicted in the drawings).

Although not depicted in the drawings, the wiring substrate has: a plurality of individual wirings which extend in the first direction and each of which is electrically connected to one of the plurality of wirings 12*e*; and a common wiring electrically connected to the common electrode 12*b*. The wiring substrate has a driver IC mounted thereon, and is connected to the controller 5 (see FIG. 1).

The driver IC generates a driving signal based on a control signal from the controller 5 (see FIG. 1) while maintaining the potential of the common electrode 12*b* at the ground potential, and applies the driving signal to each of the plurality of individual electrodes 12*d*. This causes the potential of each of the plurality of individual electrodes 12*d* to change between a predetermined driving potential and the ground potential. In this situation, a part of the vibration plate 12*a* and a part of each of the plurality of piezoelectric bodies 12*c* (the parts being actuator 12*x*) which are sandwiched between one of the plurality of individual electrodes 12*d* and one of the plurality of pressure chambers 21 are deformed so as to project toward one of the plurality of pressure chambers 21, thereby changing the volume of one of the plurality of pressure chambers 21, applying pressure to the ink in one of the plurality of pressure chambers 21, and causing the ink to be ejected or discharged from the nozzle 22.

In a case that the ink is discharged from the nozzle 22, the ink is supplied from the first common channel 31 or the second common channel 32 to each of the plurality of individual channels 20. The ink supplied to each of the plurality of individual channels 20 flows through the wide-width channel 25*a* or 25*b* and the narrow-width channel 24*a* or 24*b* and then flows into each of the first and second pressure chambers 21*a* and 21*b*. The ink moves in the second direction inside the first and second pressure chambers 21*a* and 21*b*, moves to a lower side in the third direction through the connecting channel 23, and is ejected or discharged from the nozzle 22.

As depicted in FIG. 3, the protective member 13 is adhered to an upper surface of the actuator substrate 12. The protective member 13 has two recessed parts 13*x* provided on a lower surface thereof, and a through hole 13*y* penetrating therethrough in the third direction.

The two recessed parts 13*x* extend in the first direction and are arranged side by side in the second direction. A plurality of actuators 12*x* corresponding to the first individual channel array 20A are accommodated in one of the two recessed parts 13*x*. A plurality of actuators 12*x* corresponding to the second individual channel array 20B are accommodated in the other of the two recessed parts 13*x*.

The through hole 13*y* extends in the first direction at a center in second direction of the protective member 13. The above-described wiring substrate (not depicted in the drawings) is arranged in the through hole 13*y*.

Note that in FIG. 4, the illustration of the protective member 13 and the plates 11*a* to 11*c* located above the protective member 13 are omitted.

As described above, the foregoing configuration is applied to the head 1 according to the present embodiment. In the configuration, the plurality of individual channels 20 form each of the first individual channel array 20A and the second individual channel array 20B extending in the first direction; and each of the plurality of individual channels 20 includes: a nozzle 22, at least two pressure chambers 21 (first pressure chamber 21*a* and second pressure chamber 21*b*), and a connecting channel 23 connecting the nozzle 22 and the at least two pressure chambers 21 (first pressure chamber 21*a* and second pressure chamber 21*b*). In this case, in the present embodiment, the plurality of nozzles 22 belonging to the first individual channel array 20A and the plurality of nozzles 22 belonging to the second individual channel array 20B are arranged side by side in the first direction, at the equal spacing distance therebetween (see FIG. 2). As a result, even in a case that the above-described configuration is applied, any imbalance or deviation does not occur in the arrangement of dots formed on the paper 9, and any lowering in the image quality can be suppressed.

In each of the individual channel arrays 20A and 20B, the plurality of pressure chambers 21 are arranged side by side in the first direction at the equal spacing distance therebetween (see FIG. 2). In each of the individual channel arrays 20A and 20B, the center-to-center distance Da, Db in the first direction between the two pressure chambers 21 which are adjacent to each other in the first direction and the center-to-center distance Dc between the two nozzles 22 which are adjacent to each other in the first direction and which are a nozzle included in the plurality of nozzles 22 belonging to the first individual channel array 20A and a nozzle included in the plurality of nozzles 22 belonging to the second individual channel array 20B are the same first distance D1. The plurality of pressure chambers 21 belonging to the first individual channel array 20A are arranged to be shifted in the first direction, by the first distance D1, with respect to the plurality of pressure chambers 21 belonging to the second individual channel array 20B. Each of the plurality of individual channels 20 includes the one nozzle 22, the two pressure chambers 21 which are adjacent to each other in the first direction (first pressure chamber 21*a* and a second pressure chamber 21*b*), and the connecting channel 23. In each of the plurality of individual channels 20, the one nozzle 22 is arranged at the center in the first direction between the two pressure chambers 21 (first pressure chamber 21*a* and second pressure chamber 21*b*). According to this configuration, the discharge pressure from the two pressure chambers 21 (first pressure chamber 21*a* and second pressure chamber 21*b*) is uniformly applied to the nozzle 22, and the discharge is stabilized.

The plurality of nozzles 22 belonging to the first individual channel array 20A and the plurality of nozzles 22 belonging to the second individual channel array 20B are arranged, in the second direction, between the plurality of pressure chambers 21 belonging to the first individual channel array 20A and the plurality of pressure chambers 21 belonging to the second individual channel array 20B (see FIG. 2). In this case, the area occupied by the nozzles 22 in the second direction can be made small, as compared with a case in which the plurality of nozzles 22 belonging to the first individual channel array 21A and the plurality of nozzles 22 belonging to the second individual channel array 22B sandwich the plurality of pressure chambers 22 belonging to the first individual channel array 20A and the plurality of pressure chambers 22 belonging to the second individual channel array 20B in the second direction; and the size of the part constructing the nozzles 22 (in the present embodiment, the plate 11*h*) can be made small in the second direction.

The plurality of nozzles 22 belonging to the first individual channel array 20A and the plurality of nozzles 22 belonging to the second individual channel array 20B are aligned in one array (row) along the first direction (see FIG. 2). In a configuration in which the nozzles 22 are not aligned in an array along the first direction (for example, a configuration in which the nozzles 22 are arranged in a staggered manner so as to form two arrays), in a case that dots extending linearly in the first direction are to be formed on paper 9 with the second direction as the conveyance direction, it is necessary to make a discharge timing of the ink from the nozzles 22 to be different between the individual channel arrays 20A and 20B. Further, in a case that paper 9 is conveyed while being inclined (skew) with respect to the conveyance direction due to any meandering etc., even in a case that the discharge timing is changed between the individual channel arrays 20A and 20B as described above, the landing position of the ink on the paper 9 is deviated from a desired position, and the image quality is lowered. In this respect, in present embodiment, since the nozzles 22 are arranged in one array along the first direction, the occurrence of the above-described problem can be suppressed.

The other end 23*y* of the connecting channel 23 includes the first area R1 defined by the plate 11*h* and the second area R2 arranged side by side with respect to the first area R1 in the second direction and defined by the plate 11*g* (see FIG. 3). In this case, the length in the second direction of the plate 11*h* can be shortened, thereby making it possible to reduce the cost of the material of plate 11*h*.

The linking channel 33 linking the first common channel 31 and the second common channel 32 with each other is provided, and the ink supply port 30 which is common to the first and second common channels 31 and 32 is provided (see FIG. 2 and FIG. 3). In this case, it is easier to assemble a tube, etc., with respect to the ink supply port 30 than in a case that the ink supply port 30 is provided individually for each of the first common channel 31 and the second common channel 32. In addition, the present embodiment is configured such that each of the plurality of individual channels 20 includes one nozzle 22 and two pressure chambers 21 (first pressure chamber 21*a* and second pressure chamber 21*b*), and the number of the nozzles 22 with respect to the pressure chambers 21 is small. However, a same liquid (the ink supplied from the common ink supply port 30) is made to be discharged or ejected from the nozzles 22 of the two individual channel arrays 20A and 20B, thereby making it possible to suppress any lowering in the resolution.

Second Embodiment

Next, a second embodiment of the present disclosure will be explained, with reference to FIGS. 5 and 6.

A head 201 according to the second embodiment (FIGS. 5 and 6) is similar to the head 1 according to the first embodiment (FIG. 2) in view of the point that the plurality of pressure chambers 21 are arranged side by side in the first direction at the equal spacing distance therebetween in each of the individual channel arrays 20A and 20B, and the point that the center-to-center distances Da and Db in the first direction between the two pressure chambers 21 which are adjacent to each other in the first direction in the individual channel arrays 20A and 20B, respectively, and the center-to-center distance Dc in the first direction between the two nozzles 22 which are adjacent in the first direction and which are a nozzle included in the plurality of nozzles 22 belonging to the first individual channel array 20A and a nozzle included in the plurality of nozzles 22 belonging to the second individual channel array 20B are the same distance which is the first distance D1.

Here, in the first embodiment (FIG. 2), the plurality of pressure chambers 21 belonging to the first individual channel array 20A are arranged to be shifted in the first direction, by the first distance D1, with respect to the plurality of pressure chambers 21 belonging to the second individual channel array 20B. On the other hand, in the second embodiment (FIG. 5 and FIG. 6), the plurality of pressure chambers 21 belonging to the first individual channel array 20A are arranged to be shifted, in the first direction, by a second distance D2 (a distance which is half the first distance D1), with respect to the plurality of pressure chambers 21 belonging to the second individual channel array 20B. That is, in first embodiment (FIG. 2), a shift amount in the first direction of the pressure chambers 21 between the two individual channel arrays 20A and 20B is the first distance D1 which is same as the center-to-center distances Da and Db in the first direction between the pressure chambers 21 in the individual channel arrays 20A and 20B, respectively, whereas the shift amount in the second embodiment (FIG. 5 and FIG. 6) is the second distance D2 which is half the center-to-center distances Da and Db (=D1).

Further, the head 201 according to the second embodiment (FIGS. 5 and 6) is similar to the head 1 according to the first embodiment (FIG. 2) in view of the point that each of a plurality of individual channels 220 includes one nozzle 22, two pressure chambers 21 which are adjacent to each other in the first direction (first pressure chamber 21*a* and second pressure chamber 21*b*), and a connecting channel 23.

Here, in first embodiment (FIG. 2), in each of the plurality of individual channels 20, one nozzle 22 is arranged at the center between the two pressure chambers 21 (first pressure chamber 21*a* and second pressure chamber 21*b*) in first direction. In contrast to this, in the second embodiment (FIGS. 5 and 6), one nozzle 22 is arranged at a position which is shifted by a third distance D3 (a distance which is quarter (¼) the first distance D1) with respect to a center O between the two pressure chambers 21 (first pressure chamber 21*a* and second pressure chamber 21*b*) in the first direction in each of the plurality of individual channels 220. The direction in which the nozzles 22 are shifted is different between the first individual channel array 20A and the second individual channel array 20B. Specifically, in each of the plurality of individual channels 220 belonging to the second individual channel array 20B, one nozzle 22 is located at one side in the first direction (an upper side of FIGS. 5 and 6) with respect to the center O between the two pressure chambers 21; and in each of the plurality of individual channels 220 belonging to the first individual channel array 20A, one nozzle 22 is arranged at the other side in the first direction (a lower side of FIGS. 5 and 6) with respect to the center O between the two pressure chambers 21.

Further, in the first embodiment (FIG. 2 and FIG. 3), the linking channel 33 links or connects the upper end part which is substantially at the center in the first direction in the first common channel 31 with the upper end part which is substantially at the center in the first direction in the second common channel 32. In contrast to this, in the second embodiment (FIG. 5), the linking channel 33 links one end in the first direction (an upper end of FIG. 5) in the first common channel 31 and one end in the first direction (an upper end of FIG. 5) in the second common channel 32. In the second embodiment (FIG. 5), the linking channel 33 is at a height level which is same with the first and second common channels 31 and 32, and is positioned at one side in the first direction (the upper side of FIG. 5) with respect to the first and second common channels 31 and 32.

In the second embodiment, an ink supplied from the ink supply port 30 to the linking channel 33 is branched (split) into one side (left side in FIG. 5) and the other side (right side in FIG. 5) in the second direction. The ink branched into the one side in the second direction flows into one end in the first direction in the first common channel 31, flows toward the other side (lower side in FIG. 5) in the first direction in the first common channel 31, and is supplied to the plurality of individual channels 220 belonging to the first individual channel array 20A. The ink branched into the other side in the second direction flows into one end in the first direction in the second common channel 32, flows toward the other side (lower side in FIG. 5) in the first direction in the second common channel 32, and is supplied to the plurality of individual channels 220 belonging to the second individual channel array 20B.

As described above, according to the second embodiment (FIG. 5), the head 201 can be manufactured by using an existing part, as the part constructing the plurality of pressure chambers 21 (a part having the configuration in which the plurality of pressure chambers 21 are arranged side by side in the first direction at the equal spacing distance therebetween in each of the individual channel arrays 20A and 20B; and the plurality of pressure chambers 21 belonging to the first individual channel array 20A are arranged to be shifted in the first direction, by the second spacing distance D2, with respect to the plurality of pressure chambers 21 belonging to the second individual channel array 20B: the plate 11*e* in FIG. 3), and by appropriately changing the part constructing the nozzles 22 and the connecting channels 23 (plates 11*f* to 11*h* in FIG. 3). Accordingly, there is no need to prepare a new part as the part constructing the pressure chambers 21, and the cost can be reduced.

Figure 5:
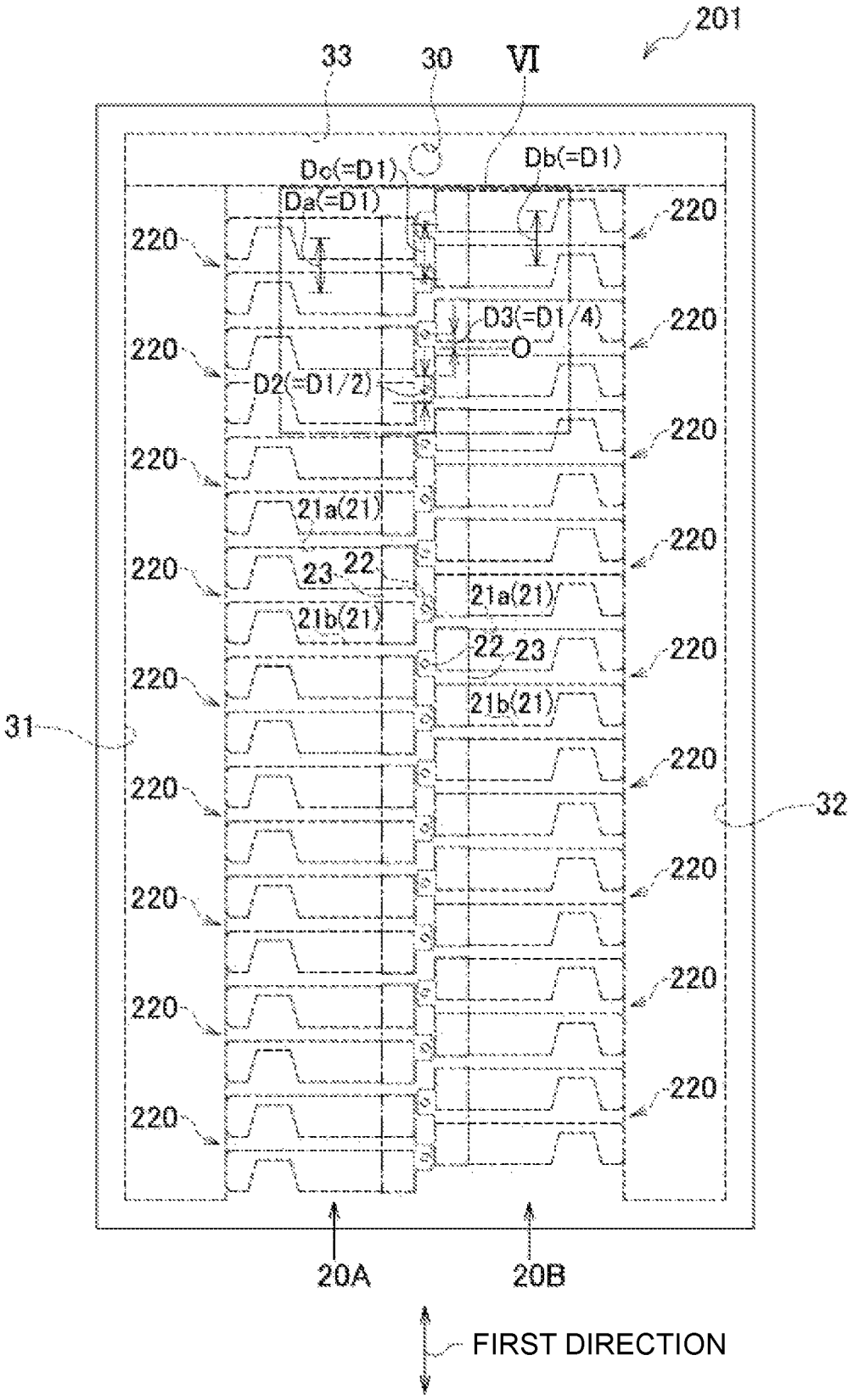
FIG. 5 is a plan view of a head according to a second embodiment of the present disclosure, corresponding to FIG. 2.
Figure 6:
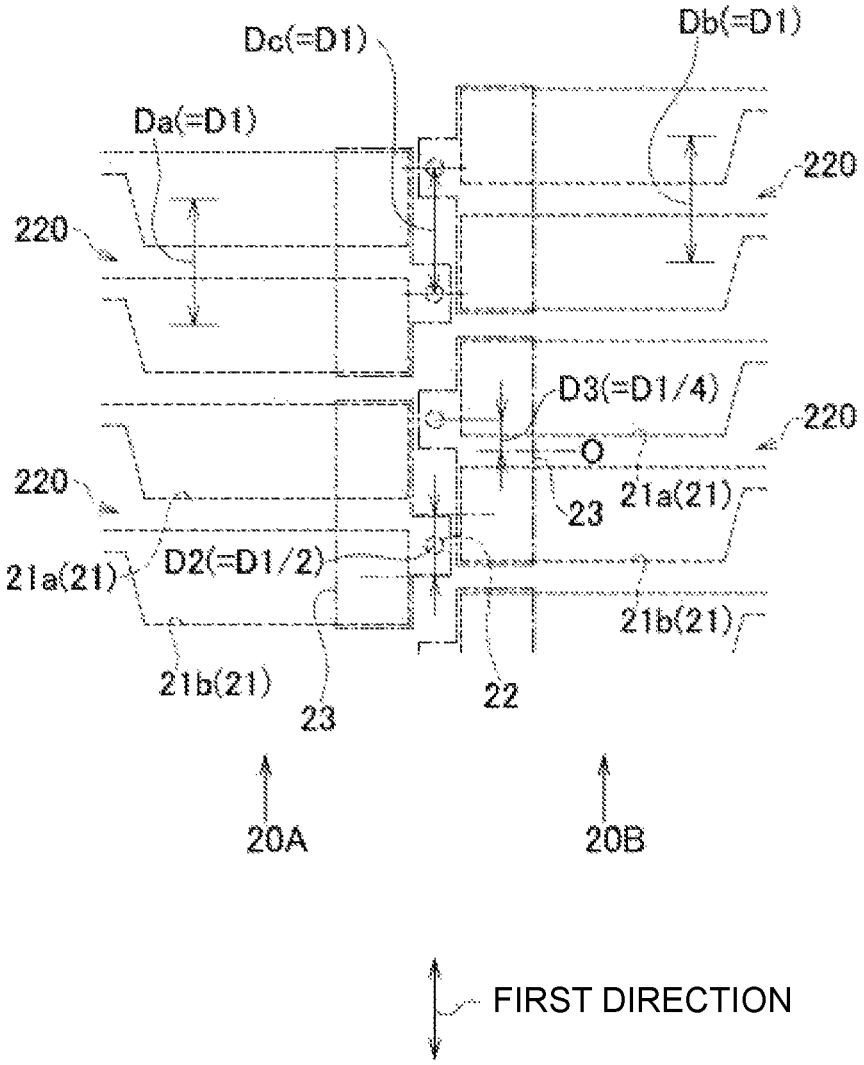
FIG. 6 is an enlarged view of an area VI depicted in FIG. 5.

The shift amount in the first direction (second distance D2) by which the pressure chambers 21 are shifted between the two individual channel arrays 20A and 20B is smaller than the shift amount in the first embodiment (first distance D1 in FIG. 2) (see FIG. 5). As a result, an area occupied by the pressure chambers 21 in the first direction can be made small, thereby making it possible to make the size of the part constructing the pressure chambers 21 to be small in the first direction.

Furthermore, in the second embodiment, the linking channel 33 is at the height level which is same as the first and second common channels 31 and 32. Therefore, the thickness (length in the third direction) of the channel substrate 11 can be made small, as compared with the first embodiment wherein the linking channel 33 and the first and second common channels 31 and 32 are at different height levels, respectively (see FIG. 3).

Third Embodiment

Figure 7:
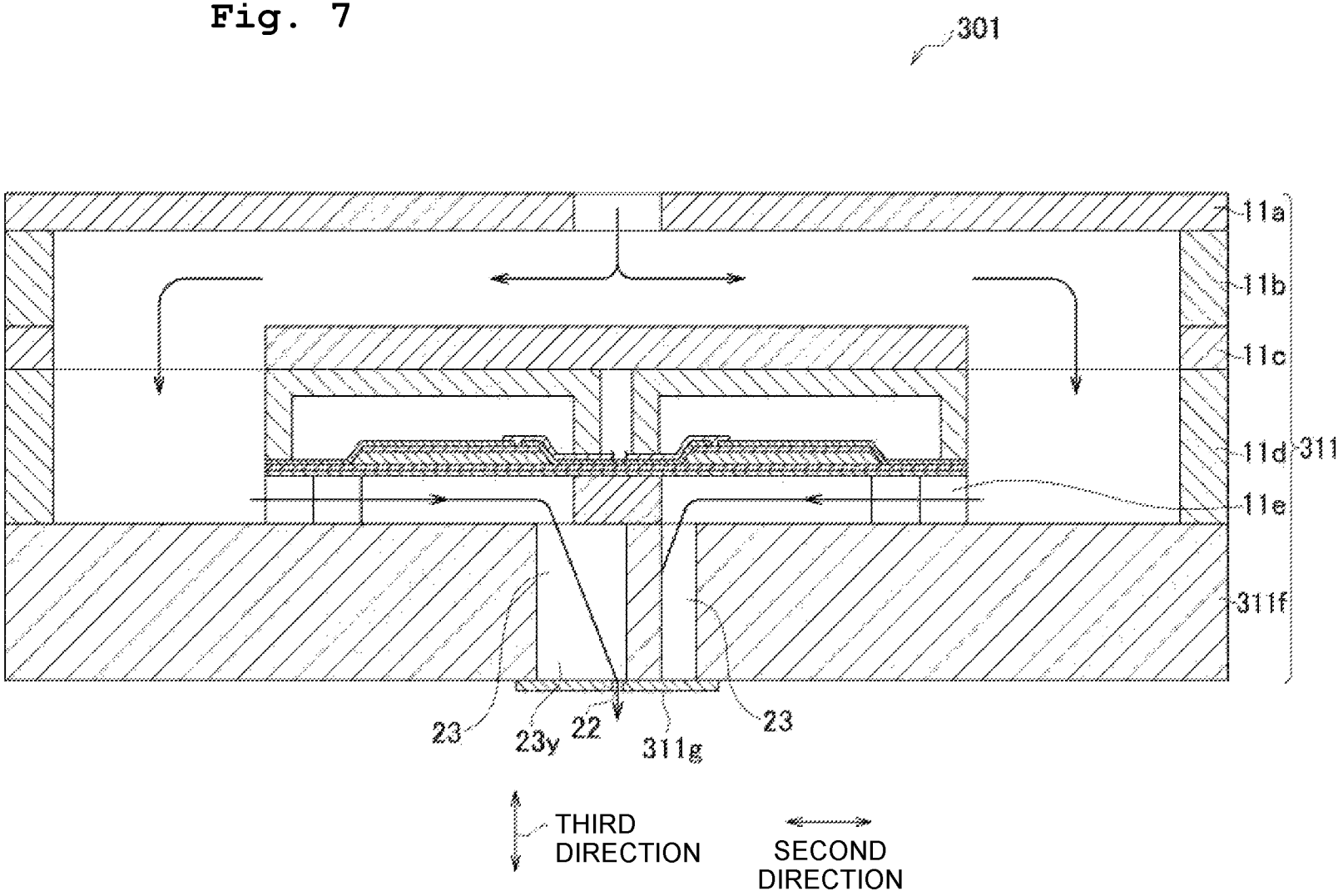
FIG. 7 is a cross-sectional view of a head according to a third embodiment of present disclosure, corresponding to FIG. 3.

Next, a third embodiment of present disclosure will be explained, with reference to FIG. 7.

In the first embodiment (FIG. 3), the connecting channel 23 is constructed of the through holes formed in the two plates 11*f* and 11*g*, and the other end 23*y* of the connecting channel 23 includes the first area R1 defined by the plate 11*h* which is one of the two plates 11*f* and 11*g* and the second area R2 arranged side by side with the first area R1 in the second direction and defined by the plate 11*g* in which the holes constructing the nozzles 22 are formed. In contrast, in the third embodiment (FIG. 7), a connecting channel 23 is constructed of a through hole formed in one plate 311*f*, and all the area of the other end 23*y* of the connecting channel 23 is defined by a plate 311*g* in which the through holes forming the nozzles 22 are formed.

In a head 301 (FIG. 7) according to the third embodiment, a channel substrate 311 is constructed of plates 11*a* to 11*e* similar to those in the first embodiment (FIG. 3), the plate 311*f* substituted for the two plates 11*f* and 11*g* in the first embodiment, and the plate 311*g* substituted for the plate 11*h* in the first embodiment.

In the third embodiment, the plate 311*g* corresponds to the "first plate" of the present disclosure, and the plate 311*f* corresponds to the "second plate" of the present disclosure. The plate 311*f* is stack in the third direction with respect to the plate 311*g*, and has the through hole constructing the connecting channel 23. The through hole of the plate 311*f* is covered with the plate 311*g*.

In the second direction, the plate 311*f* has a length which is same as those of the five plates 11*a* to 11*e* positioned above the plate 311*f*, whereas the plate 311*g* is shorter than the other plates 11*a* to 11*e* and 311*f*. The length in the second direction of the plate 311*g* is, for example, in a range of 3 mm to 5 mm.

As described above, according to the third embodiment (FIG. 7), by adopting the configuration wherein the connecting channel 23 is constructed of the through hole in the plate 311*f*, and all the area of the other end 23*y* of the connecting channel 23 is defined by the plate 311*g*, it is possible to easily form the connecting channel 23 by, for example, the etching, etc.

Fourth Embodiment

Figure 8:
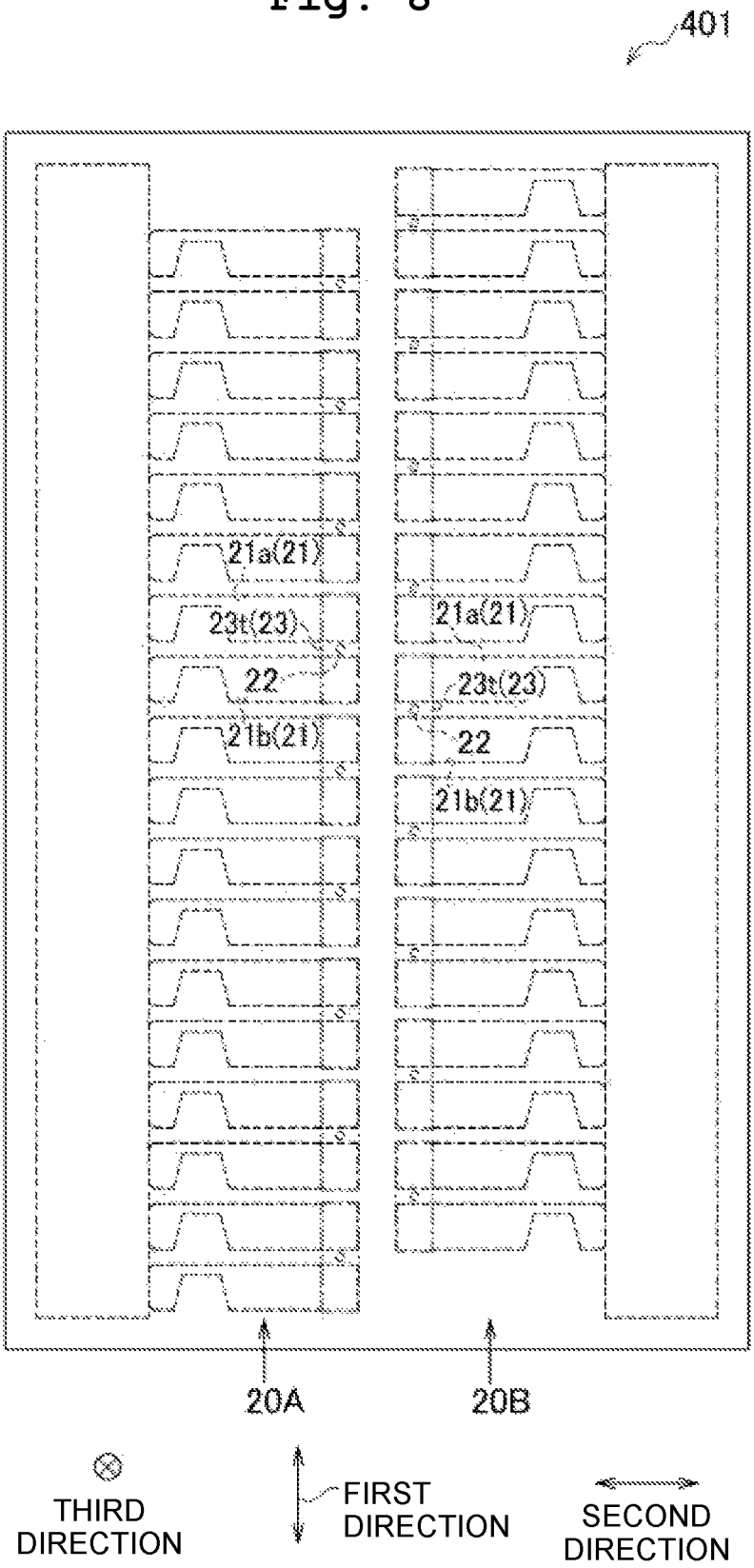
FIG. 8 is a plan view of a head according to a fourth embodiment of the present disclosure, corresponding to FIG. 2.

Next, a fourth embodiment of present disclosure will be explained, with reference to FIG. 8.

In the head 1 of the first embodiment (FIG. 2), the connecting channel 23 is T-shaped (shape of a letter "T") in the plane orthogonal to the third direction, and has the rectangular part 23*t* extending in the first direction over the one ends in the second direction of the respective two pressure chambers 21 (first pressure chamber 21*a* and second pressure chamber 21*b*), among the plurality of pressure chambers 21, corresponding to the connecting channel 23, and the projected part 23*p* projecting from the rectangular part 23*t* in the second direction to the side away from the first and second pressure chambers 21*a* and 21*b* and having the nozzle 22 provided in the lower surface thereof. In contrast to this, in a head 401 of the fourth embodiment (FIG. 8), a connecting channel 23 has no projected part 23*p* in the plane orthogonal to third direction, and has only a rectangular part 23*t* extending in the first direction over one ends in the second direction of respective two pressure chambers 21 (first pressure chamber 21*a* and second pressure chamber 21*b*), among the plurality of pressure chambers 21, corresponding to the connecting channel 23, and the nozzle 22 is arranged in the center of the rectangular part 23*t*.

Further, in the head 1 of the first embodiment (FIG. 2), the plurality of nozzles 22 belonging to the first individual channel array 20A and the plurality of nozzles 22 belonging to the second individual channel array 20B are arranged in one array along the first direction. In contrast to this, in the head 401 of the fourth embodiment (FIG. 8), a plurality of nozzles 22 belonging to the first individual channel array 20A are arranged in one array along the first direction; and a plurality of nozzles 22 belonging to the second individual channel array 20B are arranged in one array along the first direction, to be adjacent, in the second direction, to the array of the nozzles 22 of the first individual channel array 20A. That is, in the head 401 of the fourth embodiment (FIG. 8), the plurality of nozzles 22 belonging to the first individual channel array 20A and the plurality of nozzles 22 belonging to the second individual channel array 20B are arranged in a staggered manner in the first direction as a whole, and are arranged in two rows in the first direction.

According to the fourth embodiment (FIG. 8), although the fourth embodiment is different from the first embodiment in view of the above-described point, the fourth embodiment has a configuration similar to that of the first embodiment (FIG. 2), except for the above-described point, thereby making it possible to obtain effects similar to those obtained in the first embodiment (FIG. 2).

Fifth Embodiment

It is also possible to apply the present disclosure to a liquid discharging head of the circulation type. A head 501 according to a fifth embodiment of present disclosure, which is a head of the circulation type, will be explained with reference to FIGS. 9 and 10. Note that a same reference numeral is affixed to a configuration, of the head 501, which is same as that in the head 1, and any explanation therefor is omitted as appropriate.

Figure 9:
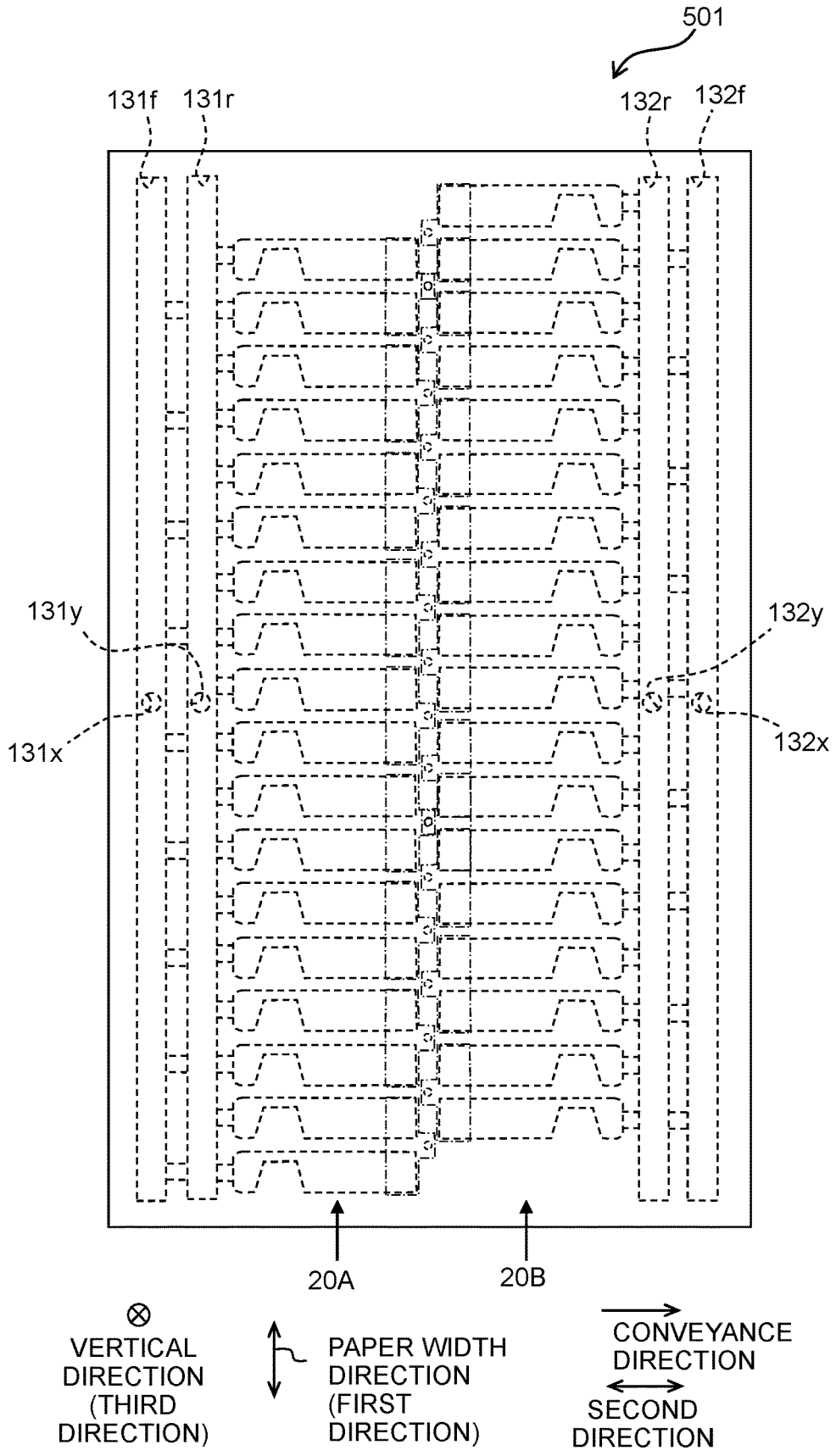
FIG. 9 is a plan view of a head according to a fifth embodiment of the present disclosure, corresponding to FIG. 2.
Figure 10:
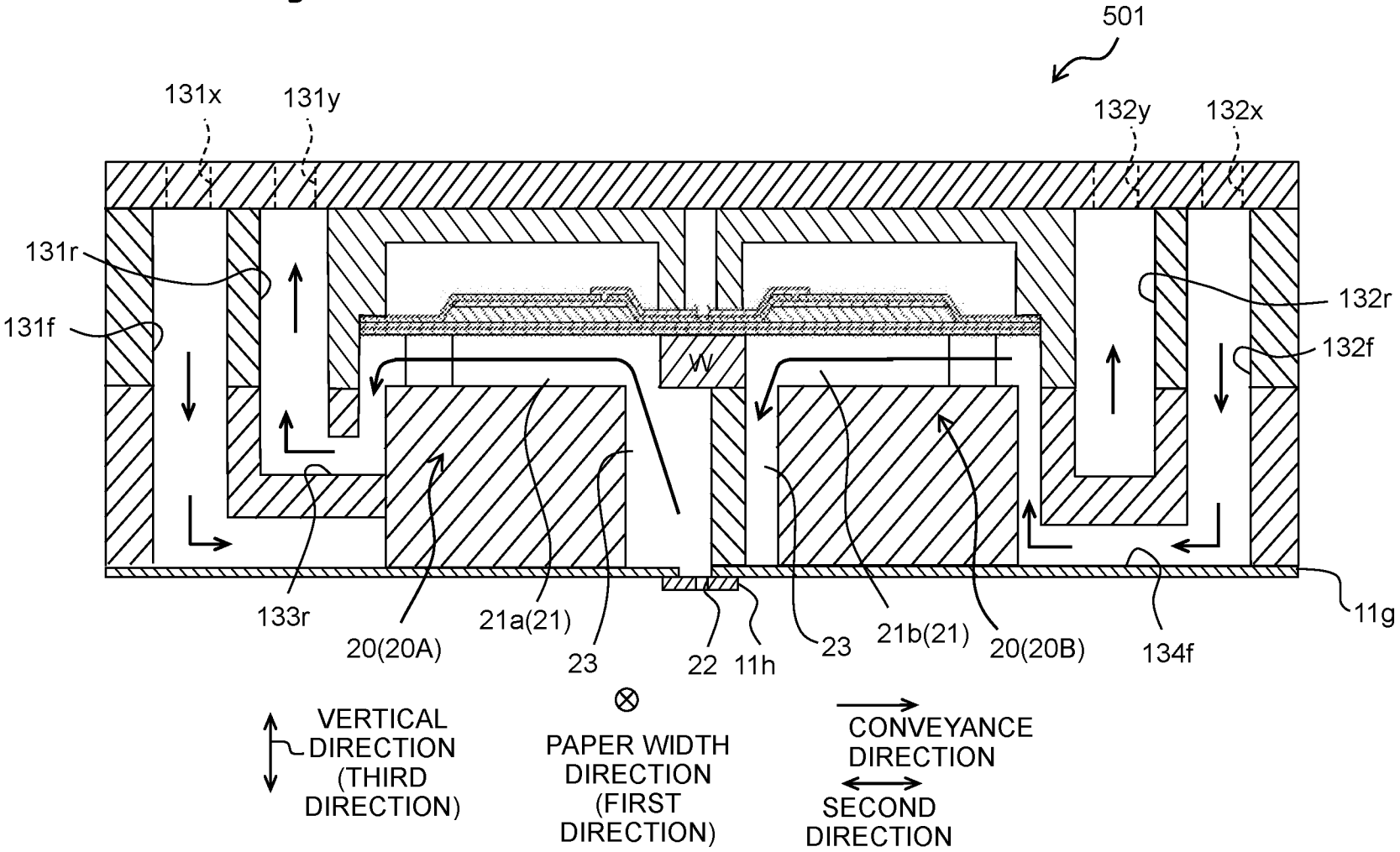
FIG. 10 is a plan view of the head according to the fifth embodiment of the present disclosure, corresponding to FIG. 3.

As depicted in FIGS. 9 and 10, the head 501 is provided with a first common supply channel 131*f* and a first common return channel 131*r*, instead of the first common channel 31; and a second common supply channel 132*f* and a second common return channel 132*r*, instead of the second common channel 32. The first common supply channel 131*f* and the first common return channel 131*r* are arranged to be side by side in the conveyance direction. Similarly, the second common supply channel 132*f* and the second common return channel 132*r* are arranged to be side by side in the conveyance direction. A first ink supply port 131*x* is formed at a central part in the paper width direction of the first common supply channel 131*f*, and a first ink recovery port 131*y* is formed at a central part in the paper width direction of the first common return channel 131*r*. Similarly, a second ink supply port 132*x* is formed at a central part in the paper width direction of the second common supply channel 132*f*, and a second ink recovery port 132*y* is formed at a central part in the paper width direction of the second common return channel 132*r*. The first ink supply port 131*x* and the second ink supply port 132*x* communicate with a non-illustrated sub tank via a non-illustrated tube and a non-illustrated pump. The first ink recovery port 131*y* and the second ink recovery port 132*y* communicate with the non-illustrated sub tank via a non-illustrated tube.

As depicted in FIGS. 9 and 10, the second common supply channel 132*f* communicates with a pressure chamber 21*b* via a supply channel 134*f*. The supply channel 134*f* extends from a lower part in the second common supply channel 132*f* to the upstream side in the conveyance direction, extends further to the upper side and communicates with the pressure chamber 21*b*. Note that although not depicted in FIG. 10, the first common supply channel 131*f* and the pressure chamber 21*a* also communicate with each other by a supply channel which is similar to the supply channel 134*f*.

As depicted in FIGS. 9 and 10, the first common return channel 131*r* communicates with a pressure chamber 21*a* via a return channel 133*r*. The return channel 133*r* extends from a lower part in the first common return channel 131*r* to the downstream side in the conveyance direction, extends further to the upper side and communicates with the pressure chamber 21*a*. Note that although not depicted in FIG. 10, the second common return channel 132*r* and the presser chamber 21*b* also communicate with each other by a return channel which is similar to the return channel 133*r*.

By the driving of the pump, the ink in the sub tank is supplied to the second common supply channel 132*f* via the second ink supply port 132*x*. The ink inside the second common supply channel 132*f* flows through the supply channel 134*f* and is supplied to the pressure chamber 21*b*. The ink supplied to the pressure chamber 21*b* flows to the connecting channel 23 and a part of the ink is discharged from the nozzle 22. The ink which is not discharged from the nozzle 22 flows toward a pressure chamber 21*a* communicating with the same connecting channel 23 as the pressure chamber 21*b* via the non-illustrated return channel. The ink inside the pressure chamber 21*a* flows toward the second common return channel 132*r* via the non-illustrated return channel. Then, the ink inside the second common return channel 132*r* is recovered to the inside of the sub tank, via the second ink recovery port 132*y*. In such a manner, the ink supplied from the second common supply channel 132*f* flows through the pressure chamber 21*b*, the pressure chamber 21*a* and flows into the second common return channel 132*r*.

Similarly, by the driving of the pump, the ink in the sub tank is supplied to the first common supply channel 131*f* via the first ink supply port 131*x*. The ink inside the first common supply channel 131*f* flows through the non-illustrated supply channel and is supplied to the pressure chamber 21*b*. The ink supplied to the pressure chamber 21*b* flows to the connecting channel 23 and a part of the ink is discharged from the nozzle 22. The ink which is not discharged from the nozzle 22 flows toward a pressure chamber 21*a* communicating with the same connecting channel 23 as the pressure chamber 21*b*. The ink inside the pressure chamber 21*a* flows to the first common return channel 131*r* via the return channel 133*r*. Then, the ink inside the first common return channel 131*r* is recovered to the inside of the sub tank, via the first ink recovery port 131*y*. In such a manner, the ink supplied from the first common supply channel 131*f* flows through the pressure chamber 21*b*, the pressure chamber 21*a* and flows into the first common return channel 131*r*.

In such a manner, by generating a flow of the ink from the first common supply channel 131*f* toward the first common return channel 131*r*, and a flow of the ink from the second common supply channel 132*f* toward the second common return channel 132*r*, the ink does not remain in the vicinity of the nozzle 22 for a long period of time. Due to this, it is possible to prevent any increase in the viscosity of the ink in the vicinity of the nozzle 22.

<Modification>

Although the embodiments of the present disclosure have been described above, the present disclosure is not limited to or restricted by the above-described embodiments, and various design changes can be made within the scope of the claims.

The plurality of nozzles belonging to the first individual channel array and the plurality of nozzles belonging to the second individual channel array may sandwich the plurality of pressure chambers belonging to the first individual channel array and the plurality of pressure chambers belonging to the second individual channel array therebetween in the second direction.

Provided that the plurality of nozzles belonging to the first individual channel array and the plurality of nozzles belonging to the second individual channel array are arranged side by side in the first direction at the equal spacing distance therebetween, it is allowable to appropriately change the center-to-center distance between the two pressure chambers which are adjacent to each other in the first direction in each of the individual channel arrays and/or the shift amount in the first direction between the (two) pressure chambers belonging to the two individual channel arrays, respectively.

In the first individual channel array and/or the second individual channel array, a nozzle which is not arranged side by side in the first direction, at an equal spacing distance, with respect to other nozzles may be present. That is, the present disclosure is not limited to such a configuration that all the nozzles belonging to the first individual channel array and the second individual channel array are arranged side by side (aligned) in the first direction at the equal spacing distance therebetween; it is allowable that at least a part of the nozzles are arranged side by side in the first direction at the equal spacing distance therebetween.

As the shift amount in the first direction of pressure chambers between the two individual channel arrays, the first distance D1 and the second distance D2 are exemplified in the first embodiment and the second embodiment, respectively; however, pressure chambers, as an object of the shift amount, are pressure chambers corresponding to the respective nozzles which are arranged side by side in the first direction at the equal spacing distance therebetween. That is, in the first individual channel array and the second individual channel array, there may be a pressure chamber which does not correspond to the above-described shift amount.

For example, it is allowable that, in FIG. 2, all the pressure chambers 21 belonging to the first individual channel array 20A are arranged to be shifted by an amount corresponding to "first distance D1×2n (n: natural number)+ first distance D1" in the first direction with respect to all the pressure chambers 21 belonging to the second individual channel array 20B. In this case, although a certain part of the nozzles 22, among the plurality of nozzles 22 belonging to the second individual channel array 20B, which is located at one end in the first direction (upper side in FIG. 2) is not arranged side by side in the first direction at the equal spacing distance, with respect to other nozzles 22, the remaining (other) nozzles 22 are arranged side by side in the first direction, at the equal spacing distance therebetween, thereby making it possible to obtain the effects of the present disclosure.

Further, it is allowable that, for example, in FIG. 5, all the pressure chambers 21 belonging to the first individual channel array 20A are arranged to be shifted by an amount corresponding to a "first distance D1×2n (n: natural number)+second distance D2" in first direction with respect to all the pressure chambers 21 belonging to the second individual channel array 20B. In this case, although a certain part of the nozzles 22, among the plurality of nozzles 22 belonging to the second individual channel array 20B, which is located at one end in the first direction (upper side in FIG. 2) is not arranged side by side in the first direction at the equal spacing distance, with respect to other nozzles 22, the remaining (other) nozzles 22 are arranged side by side in the first direction, at the equal spacing distance therebetween, thereby making it possible to obtain the effects of the present disclosure.

The present disclosure is not limited to the configuration wherein the common liquid supply port is provided with respect to the first common channel and the second common channel; it is allowable that individual liquid supply ports are provided with respect to the respective first and second common channels.

The number of the individual channel array may be not less than 3 (three).

Although the number of the nozzle belonging to each of the plurality of individual channels is one in the above-described embodiment, the number may be not less than 2 (two).

Although the number of pressure chamber belonging to each of the plurality of individual channels is two in the above-described embodiment, the number may be not less than 3 (three).

The liquid discharging head is not limited to being of the line-type, and may be of a serial-type (a system in which the liquid is ejected or discharged from the nozzles to a discharge object while the liquid discharging head is moving in a scanning direction parallel to the paper width direction).

The discharge object is not limited to paper (paper sheet) and may be, for example, cloth (fabric), a substrate, etc.

The liquid discharged or ejected from the nozzles is not limited to the ink, and may be an arbitrary liquid (e.g., a treating liquid which causes a component in the ink to aggregate or precipitate), etc.

The present disclosure is not limited to the printer, and is also applicable to a facsimile machine, a copying machine, a multi-functional peripheral, etc. The present disclosure is also applicable to a liquid discharging head used for an application different from the recording of an image (for example, a liquid discharging apparatus which discharges or ejects a conductive liquid onto a substrate to thereby form a conductive pattern on the substrate).

What is claimed is:

1. A liquid discharging head comprising:

a first individual channel array which is constructed of a plurality of individual channels aligned in a first direction; and a second individual channel array which is constructed of a plurality of individual channels aligned in the first direction, the second individual channel array being arranged side by side to the first individual channel array in a second direction orthogonal to the first direction, wherein each of the individual channels includes: a nozzle; at least two pressure chambers communicating with the nozzle and arranged side by side in the first direction; and a connecting channel connecting the nozzle and the at least two pressure chambers, the connecting channel having one end, in a third direction which is orthogonal to the first direction and the second direction, communicating with the at least two pressure chambers and the other end in the third direction communicating with the nozzle, and a plurality of nozzles belonging to the first individual channel array and a plurality of nozzles belonging to the second individual channel array are arranged side by side at an equal spacing distance therebetween in the first direction; and wherein in each of the first individual channel array and the second individual channel array, a plurality of pressure chambers are arranged side by side at an equal spacing distance therebetween in the first direction, a center-to-center distance in the first direction between two pressure chambers, which belong to each of the first individual channel array and the second individual channel array and which are adjacent to each other in the first direction, and a center-to-center distance in the first direction between two nozzles, which belong to the first individual channel array and the second individual channel array respectively and which are adjacent to each other in the first direction, are both a same first distance.

2. The liquid discharging head according to claim 1, the pressure chambers belonging to the first individual channel array are arranged to shift, in the first direction by the first distance, with respect to the pressure chambers belonging to the second individual channel array, each of the individual channels includes: the nozzle; two pressure chambers which are adjacent to each other in the first direction; and the connecting channel, and the nozzle is arranged at a center in the first direction between the two pressure chambers.

3. The liquid discharging head according to claim 1, the pressure chambers belonging to the first individual channel array are arranged to shift, in the first direction by a second distance which is half the first distance, with respect to the pressure chambers belonging to the second individual channel array, each of the individual channels includes: the nozzle, two pressure chambers which are adjacent to each other in the first direction; and the connecting channel, and the nozzle is arranged at a position which is shifted from a center in the first direction between the two pressure chambers by a third distance which is quarter the first distance.

4. The liquid discharging head according to claim 3, wherein in each of the individual channels belonging to the second individual channel array, the nozzle is arranged at one side in the first direction with respect to the center in the first direction between the two pressure chambers, and in each of the individual channels belonging to the first individual channel array, the nozzle is arranged at the other side in the first direction with respect to the center in the first direction between the two pressure chambers.

5. The liquid discharging head according to claim 1, wherein the nozzles belonging to the first individual channel array and the nozzles belonging to the second individual channel array are arranged between the pressure chambers belonging to the first individual channel array and the pressure chambers belonging to the second individual channel array, in the second direction.

6. A liquid discharging head comprising:

a first individual channel array which is constructed of a plurality of individual channels aligned in a first direction; and a second individual channel array which is constructed of a plurality of individual channels aligned in the first direction, the second individual channel array being arranged side by side to the first individual channel array in a second direction orthogonal to the first direction, wherein each of the individual channels includes: a nozzle; at least two pressure chambers communicating with the nozzle and arranged side by side in the first direction; and a connecting channel connecting the nozzle and the at least two pressure chambers, the connecting channel having one end, in a third direction which is orthogonal to the first direction and the second direction, communicating with the at least two pressure chambers and the other end in the third direction communicating with the nozzle, a plurality of nozzles belonging to the first individual channel array and a plurality of nozzles belonging to the second individual channel array are arranged side by side at an equal spacing distance therebetween in the first direction; and wherein the nozzles belonging to the first individual channel array and the nozzles belonging to the second individual channel array are arranged between the pressure chambers belonging to the first individual channel array and the pressure chambers belonging to the second individual channel array, in the second direction; and wherein the nozzles belonging to the first individual channel array and the nozzles belonging to the second individual channel array are aligned in a row along the first direction.

7. A liquid discharging head comprising:

a first individual channel array which is constructed of a plurality of individual channels aligned in a first direction; and a second individual channel array which is constructed of a plurality of individual channels aligned in the first direction, the second individual channel array being arranged side by side to the first individual channel array in a second direction orthogonal to the first direction, wherein each of the individual channels includes: a nozzle; at least two pressure chambers communicating with the nozzle and arranged side by side in the first direction; and a connecting channel connecting the nozzle and the at least two pressure chambers, the connecting channel having one end, in a third direction which is orthogonal to the first direction and the second direction, communicating with the at least two pressure chambers and the other end in the third direction communicating with the nozzle, and a plurality of nozzles belonging to the first individual channel array and a plurality of nozzles belonging to the second individual channel array are arranged side by side at an equal spacing distance therebetween in the first direction;

a first plate having a through hole which defines the nozzle; and a second plate stacked with respect to the first plate in the third direction, and having a hole which constructs the connecting channel, wherein the other end in third direction of the connecting channel includes a first area which is defined by first plate and a second area which is arranged side by side to the first area in the second direction and which is defined by the second plate.

8. The liquid discharging head according to claim 1, further comprising:

a first plate having a through hole which defines the nozzle; and a second plate stacked with respect to the first plate in the third direction, and having a hole which constructs the connecting channel, wherein the other end in third direction of the connecting channel is entirely defined by first plate.

9. The liquid discharging head according to claim 1, further comprising:

a first common channel communicating with the individual channels belonging to the first individual channel array; and a second common channel communicating with the individual channels belonging to the second individual channel array; and a linking channel linking the first common channel and the second common channel to each other, wherein a liquid supply port is provided on the linking channel.

* * * * *